US009513083B1

(12) United States Patent
Oglesby

(10) Patent No.: US 9,513,083 B1
(45) Date of Patent: Dec. 6, 2016

(54) HANDGUARD ATTACHMENT SYSTEM WITH REGISTRATION/RETENTION TAB

(71) Applicant: Paul Oglesby, Darley (GB)

(72) Inventor: Paul Oglesby, Darley (GB)

( * ) Notice: Subject to any disclaimer, the term of this patent is extended or adjusted under 35 U.S.C. 154(b) by 0 days.

(21) Appl. No.: 14/709,104

(22) Filed: May 11, 2015

Related U.S. Application Data

(60) Provisional application No. 61/991,401, filed on May 9, 2014.

(51) Int. Cl.
*F41C 23/00* (2006.01)
*F41C 23/16* (2006.01)
*F41A 3/66* (2006.01)

(52) U.S. Cl.
CPC *F41C 23/16* (2013.01); *F41A 3/66* (2013.01)

(58) Field of Classification Search
CPC ..... F41C 27/00; F41C 23/00; F41C 23/16; F41A 3/66
USPC ..... 42/71.01
See application file for complete search history.

(56) References Cited

U.S. PATENT DOCUMENTS 3,731,418 A * 5/1973 Birkenhagen ..... F41A 21/481 42/75.02
7,216,451 B1 * 5/2007 Troy ..... F41C 23/16 42/71.01
7,520,539 B2 * 4/2009 Ignaczak ..... F16L 21/065 285/367
7,574,823 B2 * 8/2009 Nakayama ..... F41A 21/481 42/75.01
7,707,762 B1 * 5/2010 Swan ..... F41G 11/003 42/105
7,716,865 B2 * 5/2010 Daniel ..... F41C 23/16 42/75.01
7,770,317 B1 * 8/2010 Tankersley ..... F41C 23/16 42/71.01
7,905,041 B1 * 3/2011 Davies ..... F41A 3/66 42/75.02
7,938,055 B2 * 5/2011 Hochstrate ..... F41A 3/66 42/127
8,046,949 B1 * 11/2011 Daniel ..... F41C 23/16 42/71.01
8,051,595 B2 * 11/2011 Hochstrate ..... F41A 5/18 42/75.01
8,141,289 B2 * 3/2012 Gomez ..... F41C 23/16 42/90
8,201,353 B1 * 6/2012 Swan ..... F41C 23/16 42/71.01

(Continued)

*Primary Examiner* — Michelle R Clement
(74) *Attorney, Agent, or Firm* — Shaddock Law Group, PC

(57) ABSTRACT

A handguard attachment systems having a handguard with at least one registration/compression slot formed in the handguard; at least one compression adjustment aperture formed through the handguard, spanning at least a portion of the compression/registration slot; a barrel nut having a registration groove around at least a portion of the barrel nut, wherein at least a portion of the barrel nut can be slidably inserted within the handguard; and a registration tab, wherein a portion of the registration tab is sized so as to be at least partially received within at least a portion of the registration/compression slot, wherein the registration tab includes at least one tab alignment aperture formed therethrough, and wherein at least a portion of the registration tab is sized so as to be at least partially received within at least a portion of the registration groove of the barrel nut.

19 Claims, 11 Drawing Sheets

(56) References Cited

U.S. PATENT DOCUMENTS 8,205,373 B1 * 6/2012 Ubl ..... F41C 23/16 42/71.01
8,230,634 B1 * 7/2012 Davies ..... F41A 3/66 42/75.02
8,234,808 B2 * 8/2012 Lewis ..... F41A 3/26 42/71.01
8,234,809 B2 * 8/2012 Daniel ..... F41C 23/16 42/71.01
8,276,304 B2 * 10/2012 Samson ..... F41C 23/16 42/112
8,347,540 B2 * 1/2013 Sirois ..... F41C 23/16 42/71.01
8,359,779 B2 * 1/2013 Daniel ..... F41C 23/16 42/71.01
8,438,770 B2 * 5/2013 Troy ..... F41C 23/16 42/71.01
8,448,367 B2 * 5/2013 Samson ..... F41A 13/12 42/75.02
8,464,457 B2 * 6/2013 Troy ..... F41C 23/16 42/71.01
8,578,642 B2 * 11/2013 Troy ..... F41C 23/16 42/71.01
8,607,490 B1 * 12/2013 Zinsner ..... F41C 23/16 42/71.01
8,640,372 B2 * 2/2014 Hochstrate ..... F41A 5/18 42/111
8,689,477 B2 * 4/2014 Gomez ..... F41C 23/16 42/72
8,689,478 B2 * 4/2014 Patel ..... F41A 3/66 42/75.02
8,713,838 B2 * 5/2014 Ubl ..... F41A 11/02 42/71.01
8,739,448 B2 * 6/2014 Kimmel ..... F41C 23/16 42/124
8,789,304 B2 * 7/2014 Engesser ..... F41A 21/481 42/75.01
8,806,792 B2 * 8/2014 Yan ..... F41C 23/16 42/71.01
8,806,793 B2 * 8/2014 Daniel ..... F41C 23/16 42/72
8,819,980 B2 * 9/2014 Geissele ..... F41C 23/16 42/71.01
8,904,691 B1 * 12/2014 Kincel ..... F41C 23/16 42/71.01
9,003,686 B2 * 4/2015 Brown ..... F41C 23/16 42/75.01
9,032,658 B2 * 5/2015 Geissele ..... F41C 23/16 42/71.01
9,086,247 B2 * 7/2015 Lessard ..... F41A 3/66
9,140,506 B2 * 9/2015 Gomez ..... F41A 21/487
9,140,520 B2 * 9/2015 Lopes ..... F41C 23/16
9,157,696 B2 * 10/2015 Dextraze ..... F41G 11/003
9,157,697 B2 * 10/2015 Leclair ..... F41C 23/16
2006/0260169 A1 * 11/2006 Samson ..... F41C 23/16 42/72
2007/0261285 A1 * 11/2007 Troy ..... F41C 23/16 42/75.03
2010/0212201 A1 * 8/2010 Kincel ..... F41G 11/003 42/2
2010/0269392 A1 * 10/2010 Swan ..... F41C 23/18 42/71.01
2011/0000119 A1 * 1/2011 Desomma ..... F41A 3/66 42/75.02
2012/0317859 A1 * 12/2012 Brown ..... F41A 3/66 42/71.01
2014/0026459 A1 * 1/2014 Yan ..... F41C 23/16 42/71.01
2014/0130390 A1 * 5/2014 Geissele ..... F41C 23/16 42/71.01
2015/0247695 A1 * 9/2015 Jarboe ..... F41A 21/485 42/71.01

* cited by examiner

HANDGUARD ATTACHMENT SYSTEM WITH REGISTRATION/RETENTION TAB

CROSS-REFERENCE TO RELATED APPLICATIONS

This patent application claims the benefit of U.S. Patent Application Ser. No. 61/991,401, filed May 9, 2014, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearm handguards. More specifically, the present disclosure relates to firearm handguard attachment systems.

2. Description of Related Art

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

One of the reasons for widespread popularity and usage of the AR-15 is its modularity. One feature that contributes to the modularity of the AR-15 is the ability to utilize a variety of handguards, some incorporating accessory rails, such as, for example, a Picatinny rail.

The interchangeability of accessories is of particular importance to military and law enforcement personnel attached to special operations units, as this allows a single firearm to be reconfigured to meet certain mission specific needs.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, the typical systems and methods for attaching handguards to the upper receiver of a firearm have various shortcomings.

In various exemplary, non-limiting embodiments, the firearm handguard attachment systems of the present disclosure comprises a handguard attachment system comprising a barrel nut and a registration tab that are used, in conjunction with several attachment or locking screws, to attach a handguard to the upper receiver of a firearm.

In still other exemplary, nonlimiting embodiments, the firearm handguard attachment system comprises a barrel nut, a registration tab, and a compression clamping portion of a handguard that are used, in conjunction with several attachment or locking screws, to attach a handguard to the upper receiver of a firearm.

Accordingly, the presently disclosed system provides a handguard attachment system that allows a user to readily install or remove a handguard from the upper receiver of a firearm.

The presently disclosed system separately provides a handguard attachment system that maintains the handguard in a fixed rotational position relative to the upper receiver of the firearm.

The presently disclosed system separately provides a handguard attachment system that maintains the handguard in a fixed longitudinal position relative to the upper receiver of the firearm.

These and other aspects, features, and advantages of the present system are described in or are apparent from the following detailed description of the exemplary, non-limiting embodiments of the present system and the accompanying figures. Other aspects and features of embodiments of the present system will become apparent to those of ordinary skill in the art upon reviewing the following description of specific, exemplary embodiments of the present system in concert with the figures.

While features of the disclosed system may be discussed relative to certain embodiments and figures, all embodiments of the disclosed system can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the disclosed system.

Any benefits, advantages, or solutions to problems that are described herein with regard to specific embodiments are not intended to be construed as a critical, required, or essential feature(s) or element(s) of the disclosed system or the claims.

BRIEF DESCRIPTION OF THE SEVERAL VIEWS OF THE DRAWINGS

As required, detailed exemplary embodiments of the disclosed system are disclosed herein; however, it is to be understood that the disclosed embodiments are merely exemplary of the invention that may be embodied in various and alternative forms, within the scope of the disclosed system. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the disclosed system.

The exemplary embodiments of this invention will be described in detail, with reference to the following figures, wherein like reference numerals refer to like parts throughout the several views, and wherein.

DETAILED DESCRIPTION OF THE INVENTION

Figure 1:
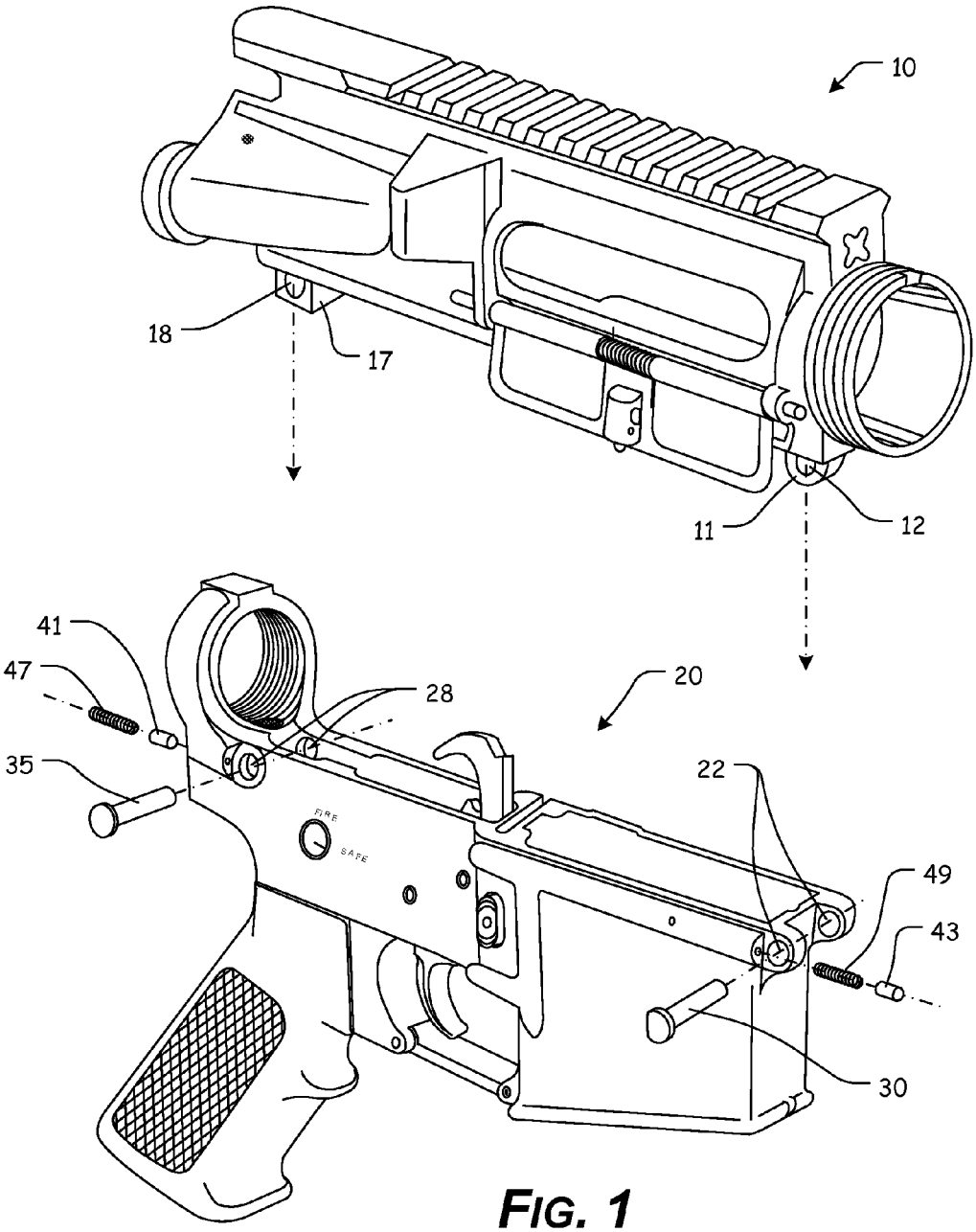
FIG. 1 PRIOR ART
FIG. 1 illustrates a perspective view of certain components of an AR-15 style upper and lower receiver.

For simplicity and clarification, the design factors and operating principles of the handguard attachment system as disclosed herein are explained with reference to various exemplary embodiments of a handguard attachment system. The basic explanation of the design factors and operating principles of the handguard attachment system is applicable for the understanding, design, and operation of the handguard attachment system. It should be appreciated that the handguard attachment system can be adapted to many applications where a handguard attachment system can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled" is defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are open-ended linking verbs. As a result, a system, device, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "handguard", "attachment system", and "upper receiver" are used for basic explanation and understanding of the operation of the systems, methods, and apparatuses of this invention. Therefore, the terms "handguard", "attachment system", and "upper receiver" are not to be construed as limiting the systems, methods, and apparatuses of this invention. Thus, the terms "handguard" and "attachment system" are to be understood to broadly include any elongate portion of material capable of being attached or coupled to an object.

For simplicity and clarification, the handguard attachment system of this invention will be described as being used in conjunction with the upper receiver of a firearm, such as a rifle or carbine. However, it should be appreciated that these are merely exemplary embodiments of the handguard attachment system and are not to be construed as limiting this invention.

Throughout this application the word "comprise", or variations such as "comprises" or "comprising" are used. It will be understood that these terms are meant to imply the inclusion of a stated element, integer, step, or group of elements, integers, or steps, but not the exclusion of any other element, integer, step, or group of elements, integers, or steps.

Figure 2:
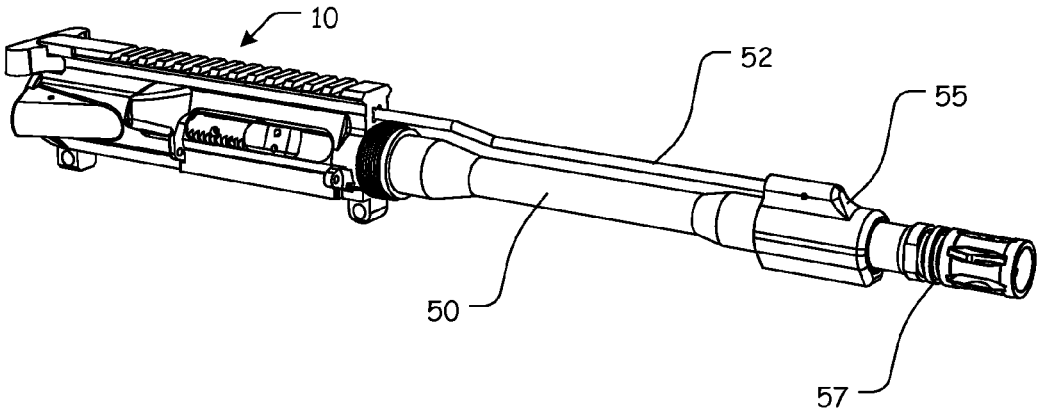
FIG. 2 PRIOR ART
FIG. 2 illustrates a perspective view of certain components of an AR-15 style upper receiver.
Figure 3:
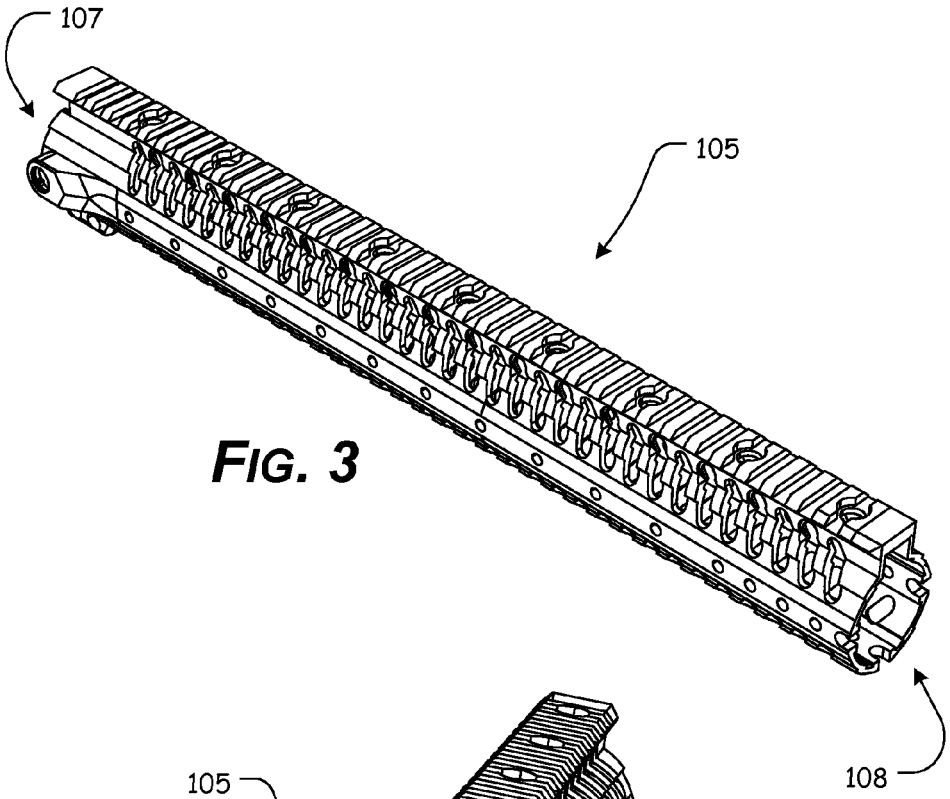
FIG. 3 illustrates a front perspective view of a first exemplary embodiment of a handguard that may optionally be utilized with a handguard attachment system, as disclosed herein.
Figure 4:
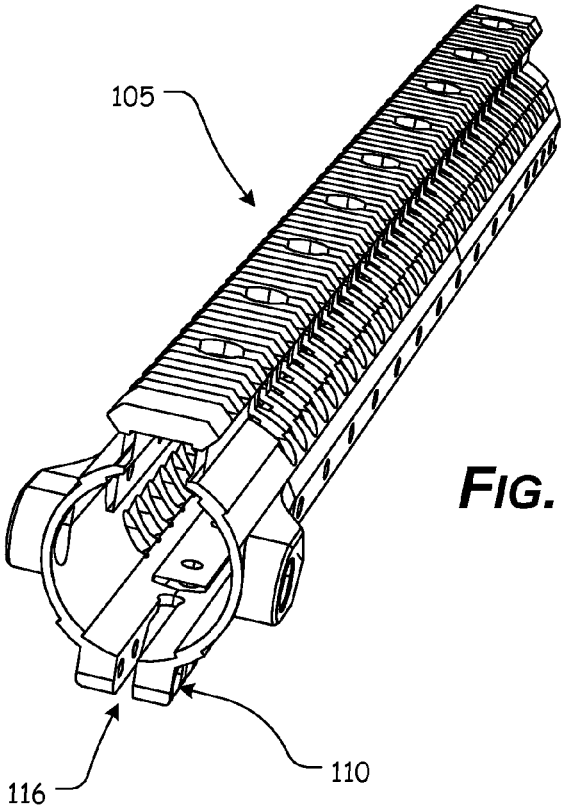
FIG. 4 illustrates a rear perspective view of a first exemplary embodiment of a handguard that may optionally be utilized with a handguard attachment system, as disclosed herein.
Figure 5:
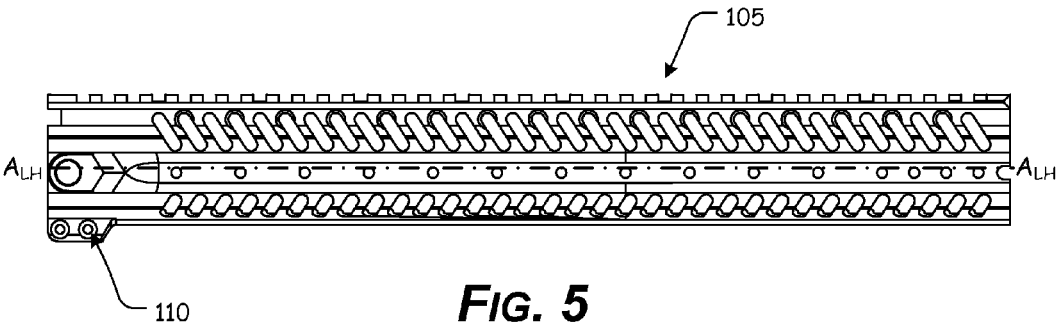
FIG. 5 illustrates a right side view of a first exemplary embodiment of a handguard that may optionally be utilized with a handguard attachment system (the left side view being a mirror image thereof), as disclosed herein.
Figure 6:
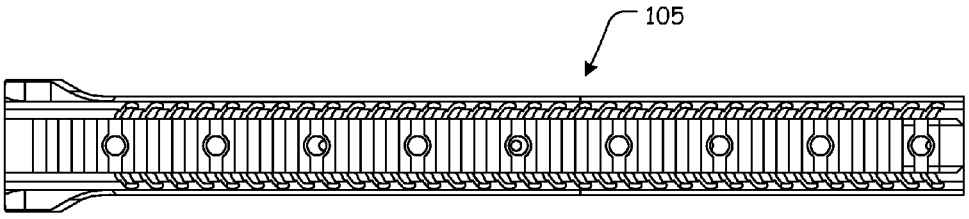
FIG. 6 illustrates a top view of a first exemplary embodiment of a handguard that may optionally be utilized with a handguard attachment system, as disclosed herein.
Figure 7:
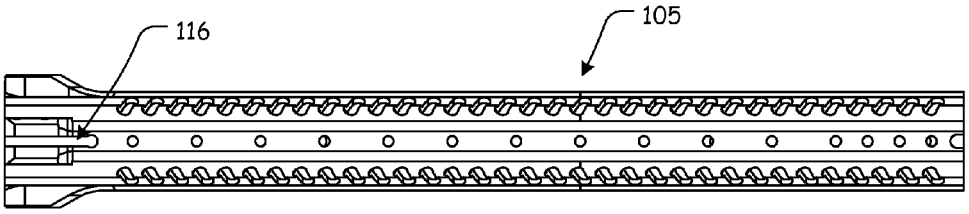
FIG. 7 illustrates a bottom view of a first exemplary embodiment of a handguard that may optionally be utilized with a handguard attachment system, as disclosed herein.
Figure 8:
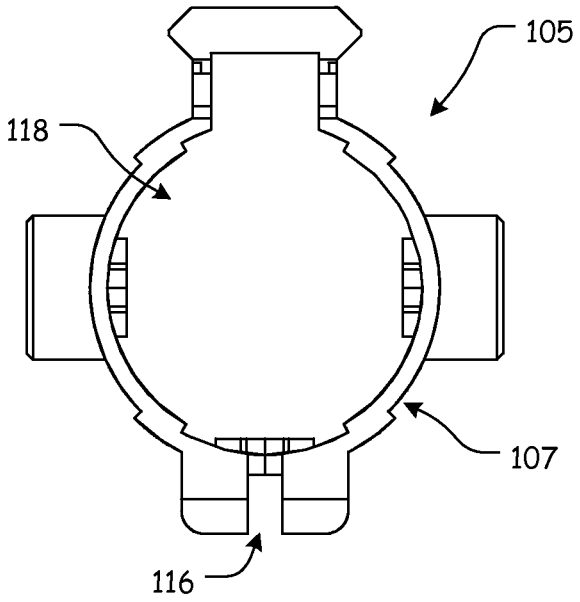
FIG. 8 illustrates a rear view of a first exemplary embodiment of a handguard that may optionally be utilized with a handguard attachment system, as disclosed herein.
Figure 9:
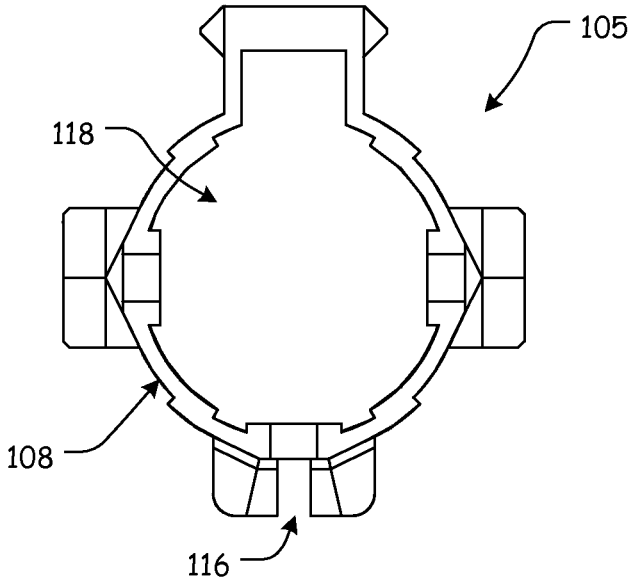
FIG. 9 illustrates a front view of a first exemplary embodiment of a handguard that may optionally be utilized with a handguard attachment system, as disclosed herein.
Figure 10:
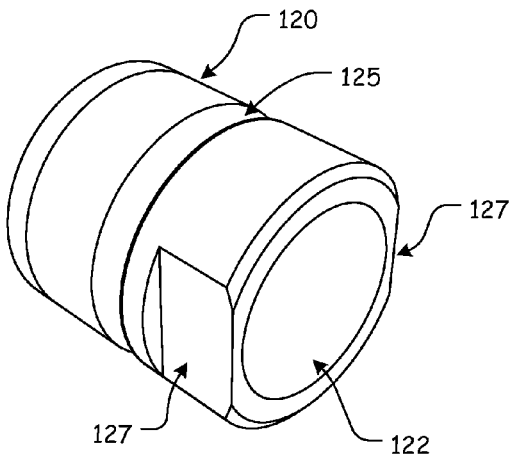
FIG. 10 illustrates a front perspective view of a first exemplary embodiment of a barrel nut that may optionally be utilized with a handguard attachment system, as disclosed herein.
Figure 11:
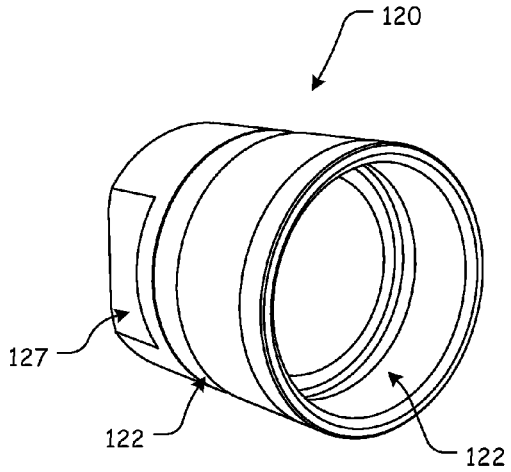
FIG. 11 illustrates a rear perspective view of a first exemplary embodiment of a barrel nut that may optionally be utilized with a handguard attachment system, as disclosed herein.
Figure 12:
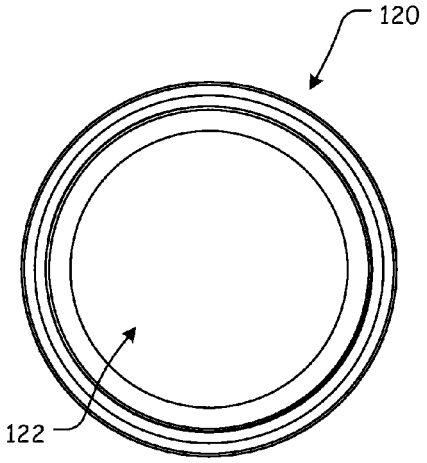
FIG. 12 illustrates a rear view of a first exemplary embodiment of a barrel nut that may optionally be utilized with a handguard attachment system, as disclosed herein.
Figure 13:
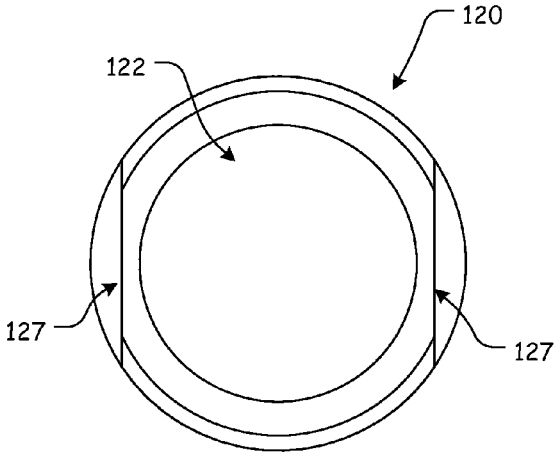
FIG. 13 illustrates a front view of a first exemplary embodiment of a barrel nut that may optionally be utilized with a handguard attachment system, as disclosed herein.
Figure 14:
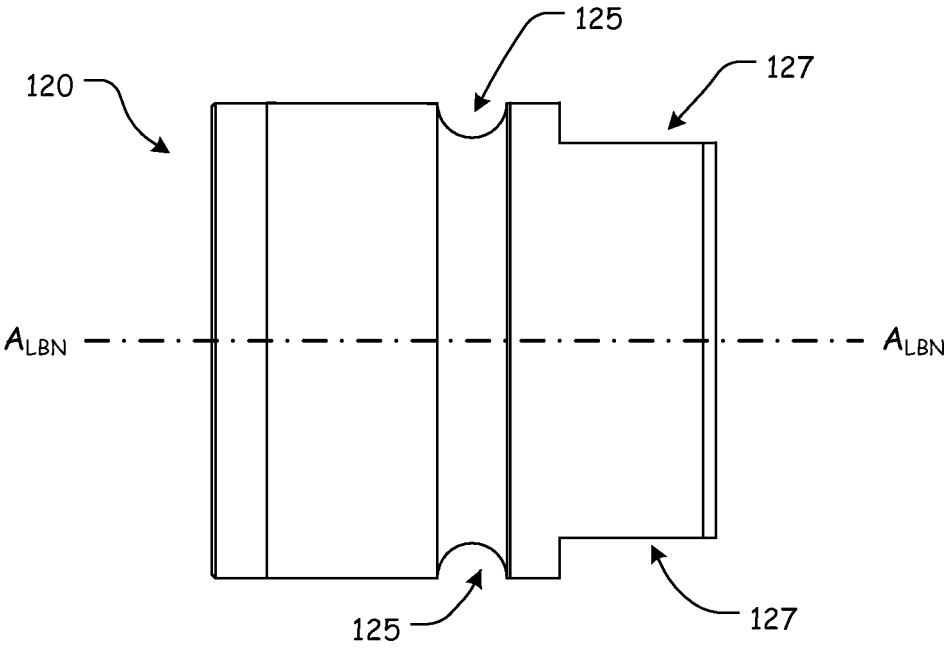
FIG. 14 illustrates a top view of a first exemplary embodiment of a barrel nut that may optionally be utilized with a handguard attachment system, as disclosed herein.
Figure 15:
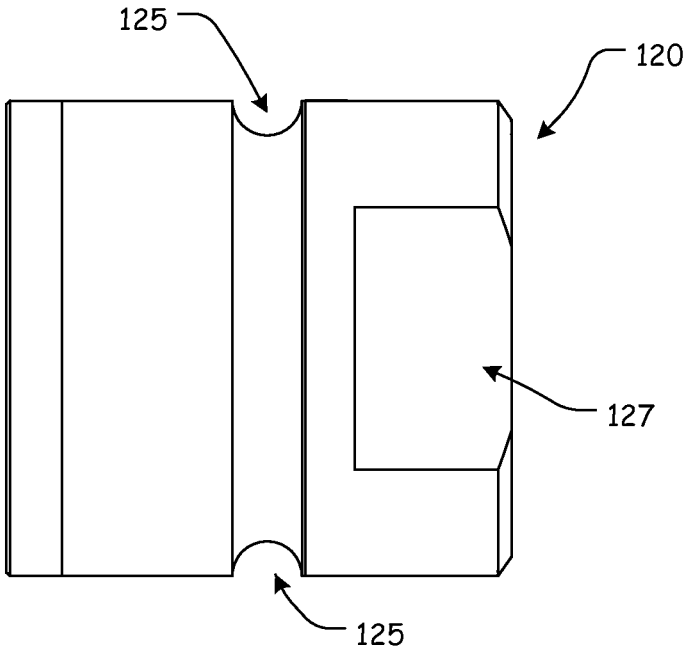
FIG. 15 illustrates a right side view of a first exemplary embodiment of a barrel nut that may optionally be utilized with a handguard attachment system, as disclosed herein.

Turning now to the drawing FIGS., FIG. 1 illustrates certain elements and/or aspects of a known, exemplary AR-15 upper receiver 10 being attached or coupled to an exemplary AR-15 lower receiver 20, while FIG. 2 illustrates certain components of an assembled upper receiver 10.

Generally, the upper receiver 10 includes an upper pivot pin lug 11 having an upper pivot pin aperture 12 and an upper take-down lug 17 having an upper take-down lug aperture 18. The lower receiver 20 includes cutouts, recesses, or areas for receiving the lugs 11 and 17 so that the upper pivot pin aperture 12 can be aligned with the lower pivot pin apertures 22 and the upper take-down lug aperture 18 can be aligned with the lower take-down lug apertures 28.

The receiver pivot pin 30 is usually maintained within at least one of the lower pivot pin apertures 22 via engagement of a detent pin 43 within a slot of the pivot pin 30. A detent pin spring 49 provides a spring biasing force that urges the detent pin 43 into the slot. Once the slot is engaged by the detent pin 43, the pivot pin 30 is slidably movable between a release position and a locking position, but is maintained within at least one of the lower pivot pin apertures 22.

When the pivot pin 30 is in the release position, the shank portion of the pivot pin 30 is outside of the cutout between the lower pivot pin apertures 22, sufficient to allow the upper pivot pin lug 11 to be positioned within or removed from the cutout between the lower pivot pin apertures 22. Alternatively, when the pivot pin 30 is in the locking position, at least a portion of the shank portion is positioned within each of the lower pivot pin apertures 22.

Detents are formed so as to be engaged by the detent pin 43 at the release position and the locking position. In this manner, additional frictional engagement is provided between the detent pin 43 and the pivot pin 30 to further secure the pivot pin 30 in the release position or the locking position.

Similarly, the receiver take-down pin 35 is usually maintained within at least one of the lower take-down pin apertures 28 via engagement of a detent pin 41 within a take-down pin slot of the take-down pin 35. A detent pin spring 47 provides a spring biasing force that urges the detent pin 41 into the take-down pin slot. Once the take-down pin slot is engaged by the detent pin 41, the take-down pin 35 is slidably movable between a release position and a locking position, but is maintained within at least one of the lower take-down pin apertures 28.

When the take-down pin 35 is in the release position, the shank portion of the take-down pin is outside of the cutout or void between the lower take-down pin apertures 28, sufficient to allow the upper take-down pin lug 17 to be positioned within or removed from the cutout between the lower take-down pin apertures 28. Alternatively, when the take-down pin 35 is in the locking position, at least a portion of the shank portion is positioned within each of the lower take-down pin apertures 28.

Detents are formed so as to be engaged by the detent pin 41 at the release position and the locking position. In this manner, additional frictional engagement is provided between the detent pin 41 and the take-down pin 35 to further secure the take-down pin 35 in the release position or the locking position.

When the upper receiver 10 and the lower receiver 20 are appropriately aligned, the upper pivot pin lug aperture 12 is aligned between the lower pivot pin lug apertures 22 such that the pivot pin 30 can be slidably moved to the locking position and the upper take-down lug aperture 18 is aligned between the lower take-down lug apertures 28 such that the take-down pin 35 can be slidably moved to the locking position. Generally, attaching the upper receiver 10 to the lower receiver 20 is accomplished by first coupling or attaching, via the pivot pin 30, the upper pivot pin lug 11 to the lower receiver 20. Then, the upper receiver 10 is pivoted, via interaction between the pivot pin 30 and the upper pivot pin lug aperture 12, until the upper take-down lug aperture 18 is appropriately aligned between the lower take-down lug apertures 28 and the take-down pin 35 is slidably moved to the locking position.

As illustrated in FIG. 2, a barrel 50 is aligned with and inserted into the upper receiver 10. A gas tube 52 extends between the upper receiver 10 and a gas block 55. A flash hider 57 or some other flash suppressor or muzzle brake is typically secured to the barrel 50.

While not illustrated in FIG. 2, the barrel 50 is typically secured to the upper receiver 10 via interaction of a threaded portion of the upper receiver 10 and an internal a threaded barrel nut.

It should also be appreciated that a more detailed explanation of the components of the upper receiver 10, lower receiver 20, and barrel 50, instructions regarding how to attach and remove the upper receiver 10, the lower receiver 20, and/or the barrel 50, and certain other items and/or techniques necessary for the implementation and/or operation of the various components of the AR-15 platform are not provided herein because such components are commercially available and/or such background information will be known to one of ordinary skill in the art. Therefore, it is believed that the level of description provided herein is sufficient to enable one of ordinary skill in the art to understand and practice the method as described.

FIGS. 3-18 illustrate certain elements and/or aspects of a first exemplary embodiment of a handguard attachment system 100, as disclosed herein. As illustrated in FIGS. 3-18, the handguard attachment system 100 comprises at least some of a handguard 105, a barrel nut 120, a registration tab 140, and attachment screws 150.

As illustrated most clearly in FIGS. 3-9, the handguard 105 comprises an elongate member extending from a first end 107 to a second end 108.

A registration/compression slot 116 is formed within a portion of the handguard 105, along the longitudinal axis, ASH, of the handguard 105. The registration/compression slot 116 is sized so as to receive at least a portion of the registration tab 140 within the registration/compression slot 116. The registration/compression slot 116 is also formed so as to allow a portion of the handguard 105 to be at least slightly compressed, thereby reducing the diameter of a handguard aperture 118.

One or more compression adjustment apertures 110 are formed through the handguard 105, proximate the first end 107 of the handguard 105, spanning the compression/registration slot 116. In various exemplary, nonlimiting embodiments, at least a portion of each compression adjustment aperture 110 is internally threaded, such that one or more attachment screws 155 can be used in connection with the compression adjustment apertures 110 to reduce the gap provided by the registration slot 116 and thereby reduce the inside diameter of the handguard aperture 118 of the handguard 105. Alternatively, the compression adjustment apertures 110 may be completely unthreaded and be formed so as to operate in conjunction with a screw and nut combination.

While the handguard 105 is illustrated as being substantially tubular and having a rail segment extending from the top side of the handguard 105 and a plurality of elongate apertures formed at spaced apart locations along the longitudinal axis or length of the handguard 105, it should be appreciated that the overall shape and appearance of the handguard 105 is a design choice based upon the desired appearance and/or functionality of the handguard 105. For example, the handguard 105 may optionally comprise a substantially cylindrical tube, without any protruding rail segment. Alternatively, the handguard the handguard 105 may optionally comprise a number of rail segments protruding from various locations along the handguard 105.

As illustrated most clearly in FIGS. 10-15, the barrel nut 120 comprises a portion of material extending from a first end to a second end and having an outer diameter. A barrel nut aperture 122 is formed through the barrel nut 120, along the longitudinal axis, $A_{LBN}$, of the barrel nut 120. The barrel nut aperture 122 includes an internally threaded portion beginning proximate the first end of the barrel nut aperture 122. The threads of the internally threaded portion of the barrel nut aperture 122 are formed so as to correspond to the external threads of the barrel receiving aperture of the upper receiver 10. In this manner, the barrel nut 120 is able to secure a barrel 50 to the upper receiver 10.

A registration groove 125 is defined by a recess around at least a portion of the outer periphery of the barrel nut 120. In various exemplary embodiments, the registration groove 125 is formed proximate a central portion of the barrel nut 120. Alternatively, the registration groove 125 may be formed proximate the first end or second end of the barrel nut 120. In various exemplary embodiments, the barrel nut 120 has an overall cylindrical shape.

Opposing flat portions 127, having parallel surfaces, are formed in the barrel nut 120 proximate the first or second end. The opposing flat portions 127 provide surfaces for a wrench or other tool to be used to threadedly attach the barrel nut 120 to an appropriately threaded portion of the upper receiver 10. It should be appreciated that the barrel nut 120 is used in place of a standard barrel nut to attach a barrel 50 to and upper receiver 10.

The outer diameter of the barrel nut 120 is substantially similar to the inner diameter of at least a portion of the first end of the handguard 105, such that at least a portion of the barrel nut 120 can be slidably inserted within at least a portion of the first end of the handguard 105.

Figure 16:
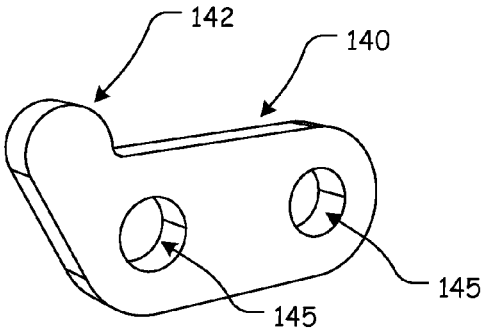
FIG. 16 illustrates a first perspective view of a first exemplary embodiment of a registration tab that may optionally be utilized with a handguard attachment system, as disclosed herein.
Figure 17:
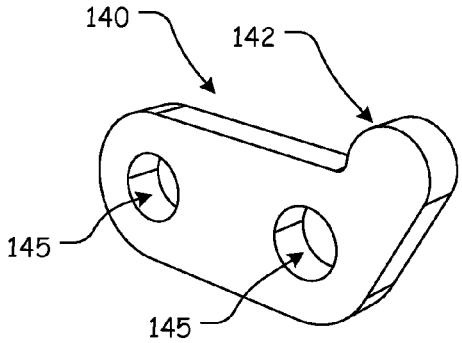
FIG. 17 illustrates a second perspective view of a first exemplary embodiment of a registration tab that may optionally be utilized with a handguard attachment system, as disclosed herein.
Figure 18:
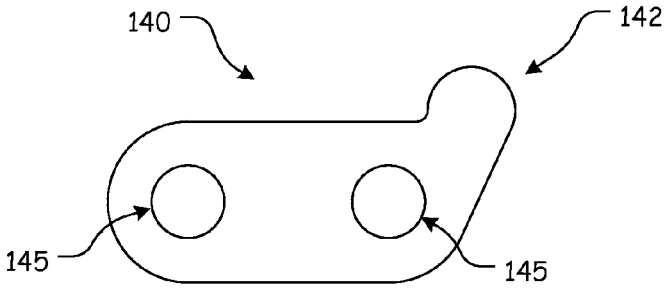
FIG. 18 illustrates a side view of a first exemplary embodiment of a registration tab that may optionally be utilized with a handguard attachment system, as disclosed herein.

As illustrated most clearly in FIGS. 16-18, the registration tab 140 extends from a body portion to a registration projection 142. In various exemplary, nonlimiting embodiments, the registration tab 140 includes at least one and optionally at least two tab alignment apertures 145 formed therethrough. Typically, the at least one aperture 145 is formed through the body portion of the registration tab 140. Each tab alignment aperture 145 is sized so as to allow one of the attachment screws 155 to pass therethrough.

The registration projection 142 of the registration tab 140 is shaped so as to be slidably positioned within at least a portion of the registration groove 125.

In various exemplary embodiments, various components of the handguard attachment system 100 are substantially rigid and are formed of metal. Alternate materials of construction of the various components of the handguard attachment system 100 may include one or more of the following: wood, steel, stainless steel, aluminum, titanium, and/or other metals, as well as various alloys and composites thereof, plastic, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the handguard attachment system 100 is a design choice based on the desired appearance and functionality of the handguard attachment system 100.

It should be appreciated that certain elements of the handguard attachment system 100 may be formed as an integral unit. Alternatively, suitable materials can be used and sections or elements made independently and attached or coupled together, such as by adhesives, welding, screws, rivets, pins, or other fasteners, to form the various elements of the handguard attachment system 100.

Figure 19:
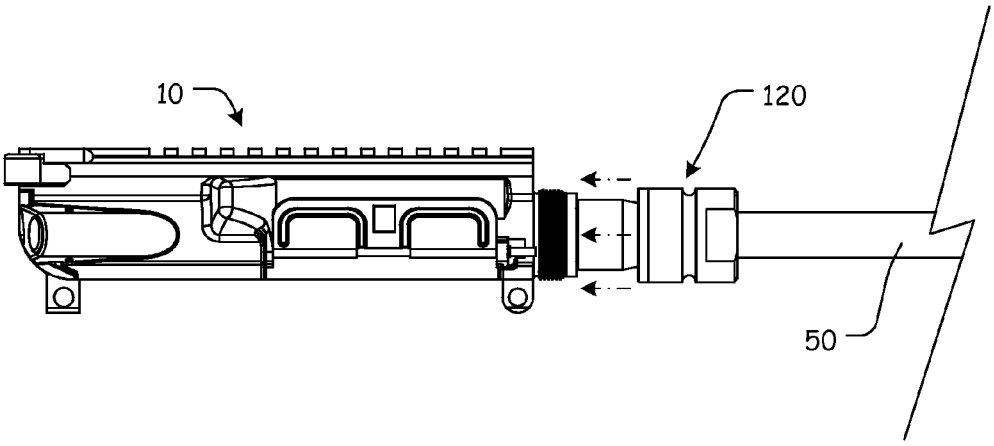
FIG. 19 illustrates a side view of a first exemplary embodiment of an exemplary handguard attachment system, wherein the barrel nut is being attached to the upper receiver.

FIGS. 19-23 most clearly illustrate how the handguard attachment system 100 is attached to an upper receiver 10 and assembled, according to this invention. As illustrated in FIG. 19, during initial assembly, the barrel nut 120 is used to threadedly attach a barrel 50 to an upper receiver 10. If needed, the opposing flat portions 127 provide surfaces for a wrench or other tool to be used to threadedly attach the barrel nut 120 to the upper receiver 10.

Figure 20:
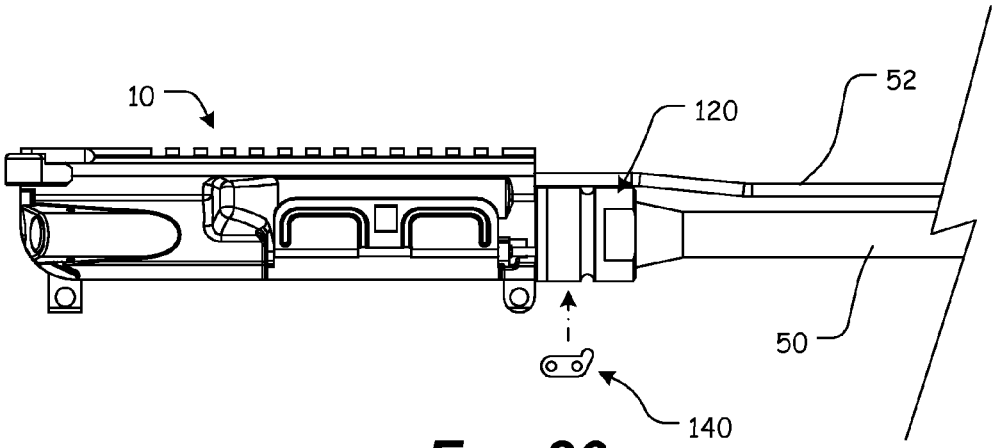
FIG. 20 illustrates a side view of a first exemplary embodiment of an exemplary handguard attachment system, wherein the registration tab is being aligned with the barrel nut.
Figure 21:
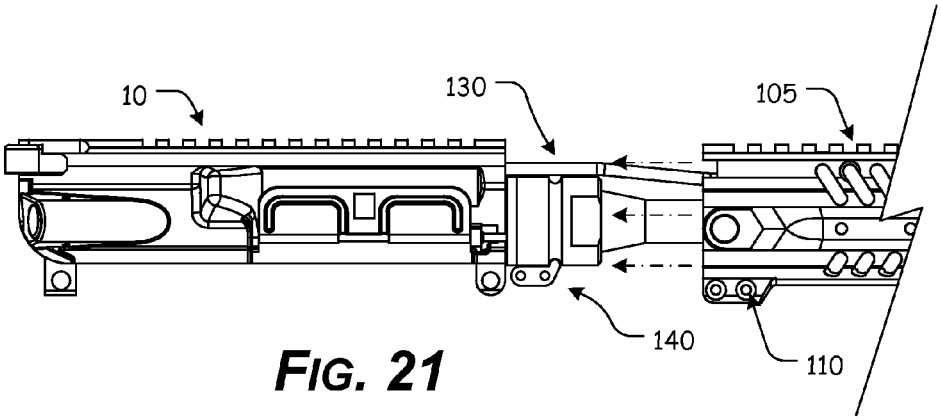
FIG. 21 illustrates a side view of a first exemplary embodiment of an exemplary handguard attachment system, wherein the handguard is being assembled over the barrel nut.

As illustrated in FIG. 20, when the barrel nut 120 is appropriately secured to the upper receiver 10, at least a portion of the registration projection 142 is positioned within at least a portion of the registration groove 125. Then, as illustrated in FIG. 21, the handguard aperture 118 of the handguard 105 is aligned with the barrel nut 120 and the registration projection 142 is aligned with the registration slot 116, such that the handguard 105 can be slidably inserted over at least a portion of the barrel nut 120.

Figure 22:
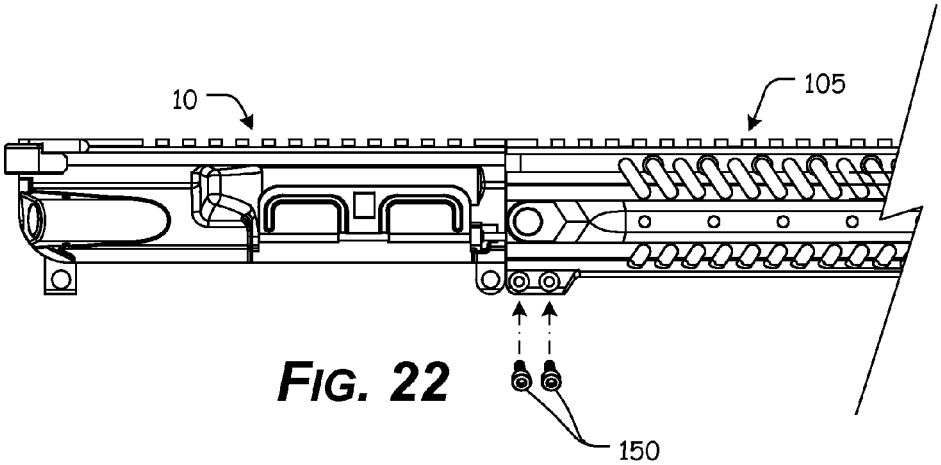
FIG. 22 illustrates a side view of a first exemplary embodiment of an exemplary handguard attachment system, wherein the handguard is being compressed to the barrel nut.

As illustrated in FIG. 22, when the handguard 105 is appropriately aligned with the barrel nut 120 and the registration tab 140, at least one attachment screw 155 is positioned within a compression adjustment aperture 110 so as to pass through the compression adjustment aperture 110 and the tab alignment aperture 145 of the registration tab 140. Additional attachment screws 155 may also optionally be positioned within any additional compression adjustment apertures 110 and/or the additional tab alignment apertures 145 of the registration tab 140. The attachment screws 155 are then secured so as to appropriately compress the handguard 105 and frictionally secure the handguard 105 to the barrel nut 120.

When this portion of the handguard attachment system 100 is assembled, at least a portion of the registration projection 142 rides in the registration groove 125 on the barrel nut 120 such that the handguard 105 cannot slide back and forth, along its longitudinal axis. The attachment screw 155 travels through the tab alignment aperture 145 of the registration tab 140 so that the assembly cannot slide forward without the attachments screw 155 being removed. By including the registration projection 142 within the registration groove 125, longitudinal movement of the handguard 105 relative to the barrel nut 120 is eliminated.

Figure 23:
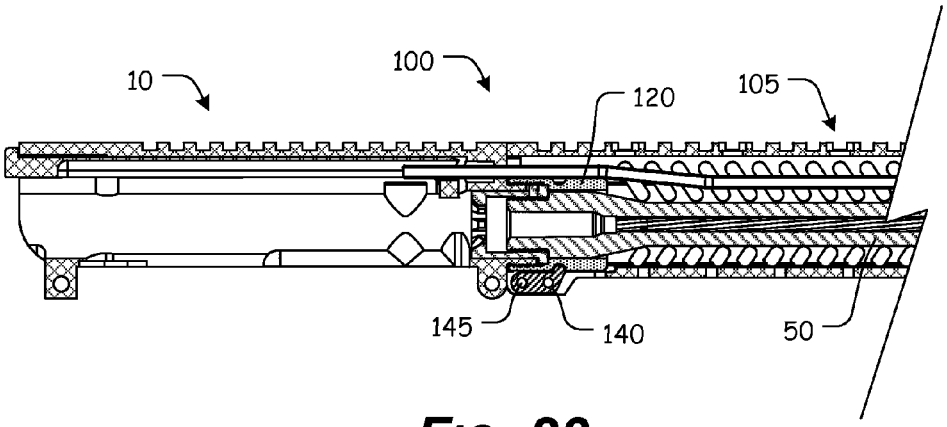
FIG. 23 illustrates a cutaway view of an assembled first exemplary embodiment of an exemplary handguard attachment system, as disclosed herein.

FIG. 23 illustrates a cutaway view of the assembled first exemplary embodiment of an exemplary handguard attachment system 100, as disclosed herein.

While the handguard attachment system has been described in conjunction with the exemplary embodiments outlined above, the foregoing description of exemplary embodiments of the handguard attachment system, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the disclosed system. Any and all such changes, variations, modifications, and/or adaptations should and are intended to be comprehended within the meaning and range of equivalents of the disclosed exemplary embodiments and may be substituted without departing from the true spirit and scope of the invention.

In addition, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A handguard attachment system, comprising:

(a) a handguard comprising an elongate member extending from a first end to a second end, wherein said handguard comprises a handguard aperture formed at least partially therethrough, and wherein at least one registration/compression slot is formed in at least a portion of said handguard, wherein each registration/compression slot is at least partially defined by at least two opposing side wall portions;

(b) one or more compression adjustment apertures formed through said handguard, spanning between at least a portion of said at least two opposing side wall portions of said registration/compression slot, such that attachment screws can interact with or within said compression adjustment apertures to reduce a distance between at least a portion of said at least two opposing side wall portions of said registration/compression slot and thereby reduce an inside diameter of at least a portion of said handguard aperture;

(c) a barrel nut having a barrel nut aperture formed therethrough, wherein said barrel nut includes a registration groove defined by a recess around at least a portion of an outer periphery of said barrel nut, and wherein an outer diameter of said barrel nut is substantially similar to an inner diameter of at least a portion of said handguard aperture, such that said barrel nut can be slidably inserted within at least a portion of said handguard; and (d) a registration tab, wherein a portion of said registration tab is sized so as to be at least partially received within at least a portion of said registration/compression slot, wherein said registration tab includes at least one tab alignment aperture formed therethrough, wherein said tab alignment aperture is sized so as to allow at least one attachment screw to pass therethrough, and wherein at least a portion of said registration tab is sized so as to be at least partially received within at least a portion of said registration groove of said barrel nut.

2. The handguard attachment system of claim 1, wherein said registration/compression slot is formed so as to allow at least a portion of said handguard to be at least slightly compressed.

3. The handguard attachment system of claim 1, wherein a plurality of compression adjustment apertures are formed through said handguard.

4. The handguard attachment system of claim 1, wherein said barrel nut aperture is formed along a longitudinal axis of said barrel nut.

5. The handguard attachment system of claim 1, wherein at least a portion of said barrel nut aperture is internally threaded.

6. The handguard attachment system of claim 1, wherein said registration/compression slot is formed along a longitudinal axis of said handguard.

7. The handguard attachment system of claim 1, wherein said at least one registration/compression slot is formed in said handguard proximate said first end of said handguard.

8. A handguard attachment system, comprising:

(a) a handguard comprising an elongate member, wherein said handguard comprises a handguard aperture formed at least partially therethrough, and wherein at least one registration/compression slot is formed in at least a portion of said handguard, wherein each registration/compression slot is at least partially defined by at least two opposing side wall portions;

(b) at least one compression adjustment aperture formed through said handguard, spanning between at least a portion of said at least two opposing side wall portions of said registration/compression slot, such that an attachment screw can interact with or within said compression adjustment aperture to reduce a distance between at least a portion of said at least two opposing side wall portions of said registration/compression slot and thereby reduce an inside diameter of at least a portion of said handguard aperture;

(c) a barrel nut having a barrel nut aperture formed therethrough, wherein said barrel nut includes a registration groove around at least a portion of an outer periphery of said barrel nut, and wherein at least a portion of said barrel nut can be slidably inserted within at least a portion of said handguard; and (d) a registration tab, wherein a portion of said registration tab is sized so as to be at least partially received within at least a portion of said registration/compression slot, wherein said registration tab includes at least one tab alignment aperture formed therethrough, wherein said tab alignment aperture is sized so as to allow at least one attachment screw to pass therethrough, and wherein at least a portion of said registration tab is sized so as to be at least partially received within at least a portion of said registration groove of said barrel nut.

9. The handguard attachment system of claim 8, wherein said registration/compression slot is formed so as to allow at least a portion of said handguard to be at least slightly compressed.

10. The handguard attachment system of claim 8, wherein a plurality of compression adjustment apertures are formed through said handguard.

11. The handguard attachment system of claim 8, wherein said barrel nut aperture is formed along a longitudinal axis of said barrel nut.

12. The handguard attachment system of claim 8, wherein at least a portion of said barrel nut aperture is internally threaded.

13. The handguard attachment system of claim 8, wherein said registration/compression slot is formed along a longitudinal axis of said handguard.

14. The handguard attachment system of claim 8, wherein said at least one registration/compression slot is formed in said handguard proximate said first end of said handguard.

15. A handguard attachment kit, comprising:

(a) a handguard, wherein said handguard comprises a handguard aperture formed at least partially therethrough, and wherein at least one registration/compression slot is formed in said handguard, wherein each registration/compression slot is at least partially defined by at least two opposing side wall portions;

(b) at least one compression adjustment aperture formed through at least a portion of said handguard, spanning across at least a portion of said at least two opposing side wall portions of said registration/compression slot;

(c) a barrel nut having a barrel nut aperture formed therethrough, wherein said barrel nut includes a registration groove around at least a portion of an outer periphery of said barrel nut, and wherein at least a portion of said barrel nut can be slidably inserted within at least a portion of said handguard; and (d) a registration tab, wherein a portion of said registration tab is sized so as to be at least partially received within at least a portion of said registration/compression slot between portions of said at least two opposing side wall portions, wherein said registration tab includes at least one tab alignment aperture formed therethrough, wherein said tab alignment aperture is sized so as to allow at least one attachment screw to pass therethrough, and wherein at least a portion of said registration tab is sized so as to be at least partially received within at least a portion of said registration groove of said barrel nut.

16. The handguard attachment kit of claim 15, wherein said at least one registration/compression slot is formed in said handguard proximate said first end of said handguard.

17. The handguard attachment kit of claim 15, wherein an attachment screw can interact with or within said compression adjustment aperture to reduce said registration/compression slot and thereby reduce an inside diameter of said handguard aperture.

18. The handguard attachment kit of claim 15, wherein at least a portion of said barrel nut aperture is internally threaded.

19. The handguard attachment kit of claim 15, wherein when said at least one compression adjustment aperture is aligned with said at least one tab alignment aperture, an attachment screw may be positioned at least partially through said at least one compression adjustment aperture and said at least one tab alignment aperture.

* * * * *